US009828760B2

(12) United States Patent
Drew

(10) Patent No.: US 9,828,760 B2
(45) Date of Patent: Nov. 28, 2017

(54) FORMWORK FOR USE IN THE CONSTRUCTION OF ARCHED STRUCTURES AND METHOD OF CONSTRUCTING ARCHED STRUCTURES

(71) Applicant: Lock-Block Ltd., Richmond (CA)

(72) Inventor: James Joseph Drew, Richmond (CA)

(73) Assignee: Lock-Block Ltd., Richmond (CA)

( * ) Notice: Subject to any disclaimer, the term of this patent is extended or adjusted under 35 U.S.C. 154(b) by 0 days.

(21) Appl. No.: 15/340,846

(22) Filed: Nov. 1, 2016

(65) Prior Publication Data

US 2017/0051496 A1 Feb. 23, 2017

Related U.S. Application Data

(63) Continuation of application No. 13/421,392, filed on Mar. 15, 2012, now Pat. No. 9,481,993.

(60) Provisional application No. 61/453,058, filed on Mar. 15, 2011, provisional application No. 61/578,181, filed on Dec. 20, 2011.

(51) Int. Cl.

| | |
|---|---|
| ***E04B 1/32*** | (2006.01) |
| ***E04G 11/36*** | (2006.01) |
| ***E04G 21/18*** | (2006.01) |
| ***E21D 11/08*** | (2006.01) |
| ***E21D 11/40*** | (2006.01) |
| ***E01D 4/00*** | (2006.01) |
| *E01F 5/00* | (2006.01) |
| *E04B 1/04* | (2006.01) |
| *E04B 1/35* | (2006.01) |

(52) U.S. Cl.

CPC ..... *E04B 1/3205* (2013.01); *E01D 4/00* (2013.01); *E04G 11/36* (2013.01); *E04G 21/1866* (2013.01); *E21D 11/08* (2013.01); *E21D 11/40* (2013.01); *E01F 5/005* (2013.01); *E04B 1/04* (2013.01); *E04B 2001/327* (2013.01); *E04B 2001/3217* (2013.01); *E04B 2001/3566* (2013.01)

(58) Field of Classification Search

CPC ..... E04B 2001/3217; E04B 2001/327; E04B 1/3205; E01D 4/00; E04G 11/36; E04G 21/1866; E21D 11/40; E21D 11/08; E21D 11/06

USPC ..... 52/127.1, 127.2, 749.1, 749.13, 86, 87; 249/209

See application file for complete search history.

(56) References Cited

U.S. PATENT DOCUMENTS 375,620 A * 12/1887 Gorman ..... E04G 11/36 249/209
749,735 A * 1/1904 Jackson ..... A01B 33/00 249/209
796,805 A * 8/1905 Burton ..... E04G 11/36 249/209
859,478 A * 7/1907 Beighle ..... E04G 11/36 249/209

(Continued)

*Primary Examiner* — Adriana Figueroa
*Assistant Examiner* — Jessie Fonseca
(74) *Attorney, Agent, or Firm* — Cameron IP

(57) ABSTRACT

A formwork for constructing an arched structure comprises a first end panel and a second end panel. A plurality of longitudinal members extends between the first end panel and the second end panel. The longitudinal members are arranged in an arched formation and the longitudinal members slope between the first end panel and the second end panel. The formwork may have rollers disposed along lengths of the longitudinal members.

7 Claims, 14 Drawing Sheets

(56) References Cited

U.S. PATENT DOCUMENTS 862,418 A * 8/1907 Street ..... E04G 21/1841 249/11
982,241 A * 1/1911 Burk ..... E04G 11/36 249/209
1,071,118 A * 8/1913 Watson ..... E04G 11/36 249/209
1,112,542 A * 10/1914 Loser ..... E04G 11/36 249/181
1,142,669 A * 6/1915 Camblin ..... E04G 11/36 249/209
1,171,316 A * 2/1916 Camblin ..... E04G 11/36 249/209
1,284,766 A * 11/1918 Popendick ..... E04G 11/36 249/209
1,313,355 A * 8/1919 Torner et al. ..... E04G 11/36 249/209
1,424,342 A * 8/1922 Compton ..... F16L 1/038 249/209
1,498,651 A * 6/1924 Folwell ..... E21D 11/40 249/11
1,621,538 A * 3/1927 Heller ..... E21D 11/40 249/11
2,611,330 A * 9/1952 Kirk ..... F27D 1/16 264/30
3,022,562 A * 2/1962 Card ..... E21D 11/102 425/468
3,131,790 A * 5/1964 Reighart ..... E04G 21/1841 52/127.1
3,274,305 A * 9/1966 Short ..... E04G 11/48 249/209
3,494,082 A * 2/1970 Adams ..... E04B 1/3205 52/478
3,855,801 A * 12/1974 Bernold ..... E01C 3/006 405/150.1
3,885,397 A * 5/1975 Fujimori ..... E21D 19/04 405/288
3,940,105 A * 2/1976 Metrailer ..... E04G 11/062 249/18
4,826,639 A * 5/1989 Vidal ..... B28B 7/04 249/11
5,284,404 A * 2/1994 Hu ..... E21D 11/40 405/142
5,329,743 A * 7/1994 Legnante ..... E04G 21/1841 269/904
5,444,948 A * 8/1995 Trapp ..... E04G 21/1841 52/127.2
6,000,193 A * 12/1999 Valero-Cuevas ..... E04G 15/00 52/749.1
6,240,686 B1 * 6/2001 Mill ..... E04B 1/3205 52/223.1
6,406,220 B1 * 6/2002 Thomson ..... E21D 9/005 405/132
6,640,505 B1 * 11/2003 Heierli ..... E02D 29/045 52/169.14
6,877,283 B2 * 4/2005 Yoshiwara ..... E04B 2/04 264/275
6,988,337 B1 * 1/2006 Heierli ..... E02D 29/05 405/134
7,305,798 B1 * 12/2007 Heierli ..... E02D 29/05 405/125
2003/0159370 A1 * 8/2003 Drew ..... E01D 4/00 52/89
2006/0059859 A1 * 3/2006 Knerr ..... E04G 21/1841 52/749.13
2006/0174548 A1 * 8/2006 Bass ..... E06B 1/006 52/86
2006/0174549 A1 * 8/2006 Dagher ..... E02D 29/05 52/86
2008/0040981 A1 * 2/2008 Lindstrom ..... E04H 9/14 52/30
2008/0256894 A1 * 10/2008 Marsh ..... E02D 27/02 52/719

* cited by examiner

FORMWORK FOR USE IN THE CONSTRUCTION OF ARCHED STRUCTURES AND METHOD OF CONSTRUCTING ARCHED STRUCTURES

BACKGROUND OF THE INVENTION

Field of the Invention

The present invention relates to the construction of arched structures and, in particular, to a formwork for use in the construction of arched structures and a method of constructing arched structures.

Description of the Related Art

It is known to use arched structures in bridges, culverts, sewers and tunnels among other things. Traditionally, arched structures were constructed by successively setting voussoirs until a central voussoir or keystone can be set. The arched structure then becomes complete and self-supporting. Compressive forces hold the voussoirs together in a state of equilibrium and, in theory, may provide the arched structure with an indefinite lifespan. Arched structures constructed during the time of the Roman Empire still stand today. There are however significant limitations to traditional methods of constructing arched structures, the foremost being the time consuming processes of setting the voussoirs and moving a formwork forward to lengthen the arched structure.

Following the development of modern hydraulic cement, and the increased use of concrete in construction, arched structures are now typically constructed by casting concrete on arch shaped linings. This allows for the rapid construction of arched structures of varying lengths. However, concrete cast arched structures often require reinforcement bars to resist forces other than compressive forces. This limits the lifespan of concrete cast arched structures as even epoxy coated, galvanized and stainless steel reinforcement bars eventually corrode. Corrosion of the reinforcement bars may lead to the cracking, spalling and ultimately structural failure of the arched structure.

There is accordingly a need for an improved system and method of constructing arched structures.

SUMMARY OF THE INVENTION

There is provided a formwork for constructing an arched structure. The formwork comprises a first end, a second end, and a plurality of longitudinal members extending between the first end of the formwork and the second end of the formwork. The longitudinal members are arranged in an arched formation and the longitudinal members slope between the first end of the formwork and the second end of the formwork. The first end and second end of the formwork may each include an end panel with an arcuate peripheral edge.

The formwork may have rollers mounted along the longitudinal members. There may be a longitudinal base member extending between the first end of the formwork and the second end of the formwork. The longitudinal base member may be releasably connected to the second end of the formwork, and a slope of at least one of the longitudinal members may be adjusted by repositioning the longitudinal base member relative to the second end of the formwork.

The formwork may also have an actuator or vibrator for imparting movement to at least one of the longitudinal members. There may be a plurality of radially extending struts at a first end of the formwork. Each of the longitudinal members may be coupled to a corresponding one of the radially extending struts. The actuator may couple at least one of the longitudinal members to a corresponding one of the radially extending struts. The actuator may move the said at least one longitudinal member relative to the said corresponding one of the radially extending struts.

An alternative embodiment of the formwork comprises a first end, a second end, and an arched surface extending between the first end of the formwork and the second end of the formwork. The arched surface slopes between the first end of the formwork and the second end of the formwork. The formwork may include a longitudinal base member extending between the first end of the formwork and the second end of the formwork. The longitudinal base member may be releasably connected to the second end of the formwork, and a slope of the arched surface may be adjusted by repositioning the longitudinal base member relative to the second end of the formwork.

There is also provided a method of constructing an arched structure comprising:

a) providing a formwork having a first end, a second end, and a longitudinal member extending between the first end of the formwork and the second end of the formwork, wherein the longitudinal member slopes downwardly from the first end of the formwork to the second end of the formwork;

b) using the formwork to support placing a plurality of interlocking voussoirs and keystones during the constructing of a portion of the arched structure; and c) pulling the formwork out of the portion of the arched structure after the interlocking voussoirs and keystones are placed, wherein the formwork is pulled out of the portion of the arched structure by the first end of the formwork to cause the voussoirs to move inward and the keystones downward and thereby causing the voussoirs and the keystones to interlock.

The formwork may be provided with an actuator or vibrator. The actuator or vibrator may be used to impart movement to the longitudinal member to cause offset voussoirs to be set. Tension straps may be extended along an extrados of the arched structure to prevent outward movement of the voussoirs. Tensions straps may also or alternatively be extended along an intrados of the arched structure to prevent inward movement of the voussoirs. The arched structure may be provided with a lining and, in one embodiment, the extrados of the arched structure may be provided with an epoxy lining.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
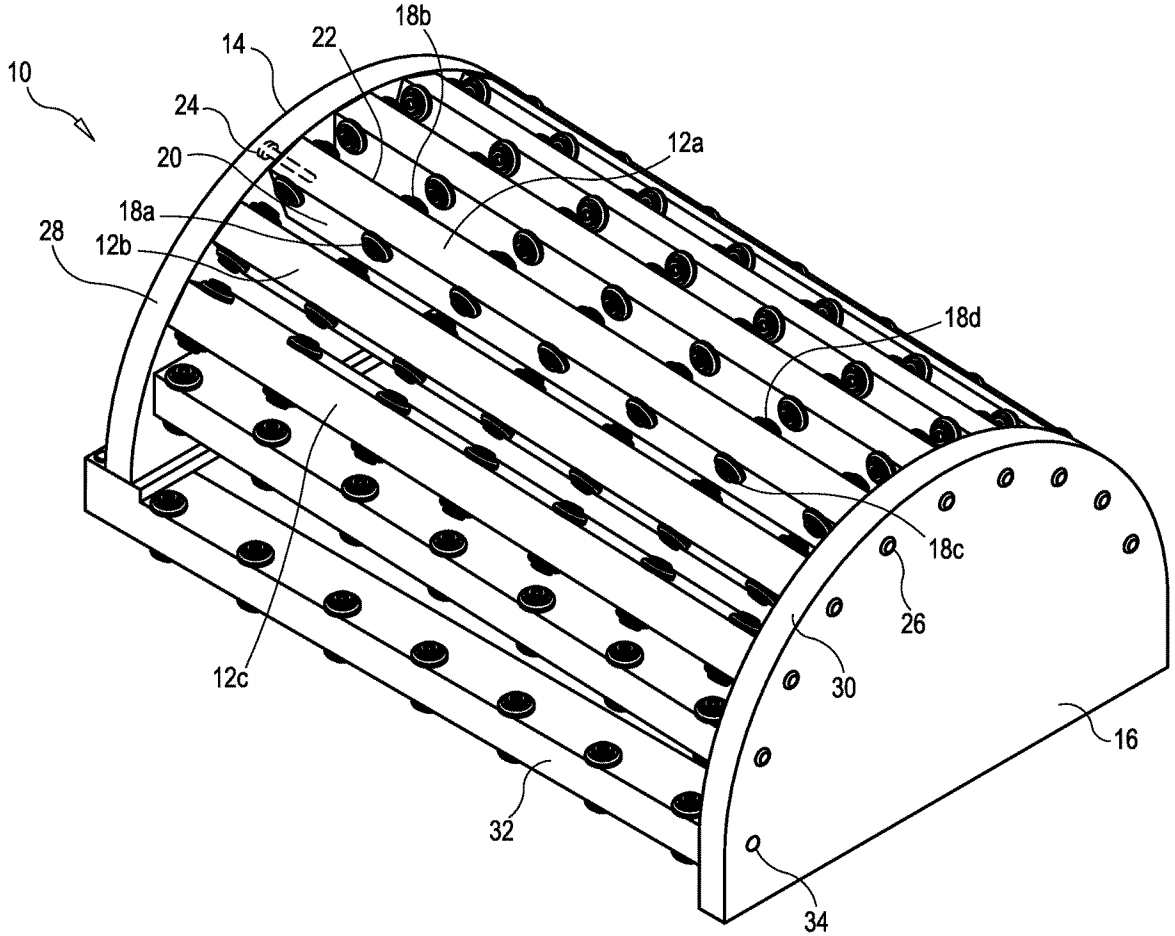
FIG. 1 is a perspective view showing a first embodiment of an improved formwork for use in the construction of an arched structure.

Referring to the drawings and first to FIG. 1, a first embodiment of an improved formwork 10 for use in the construction of an arched structure is shown. The formwork 10 includes a plurality of longitudinal members, for example longitudinal members 12*a*, 12*b* and 12*c*, which extend between end panels 14 and 16. The longitudinal members are substantially similar in structure and function. Accordingly, only one of the longitudinal members 12*a* is described in detail herein with the understanding that the remaining longitudinal members have a substantially similar structure and function in a substantially similar manner. The longitudinal member 12*a* has a plurality of spaced apart rollers, for example rollers 18*a*, 18*b*, 18*c* and 18*d*, disposed along a length thereof. In this example, the rollers are mounted as opposed pairs. Roller 18*a* is mounted on a first side 20 of the longitudinal member 12*a* opposite roller 18*b* which is mounted on a second side 22 of the longitudinal member 12*a*. Likewise roller 18*c* is mounted on the first side 20 of the longitudinal member 12*a* opposite roller 18*d* which is mounted on the second side 22 of the longitudinal member 12*a*. The longitudinal member 12*a* is secured to each of the end panels 14 and 16 by a corresponding bolt 24 and 26. This allows the longitudinal member 12*a* to be easily removed or replaced.

Figure 2:
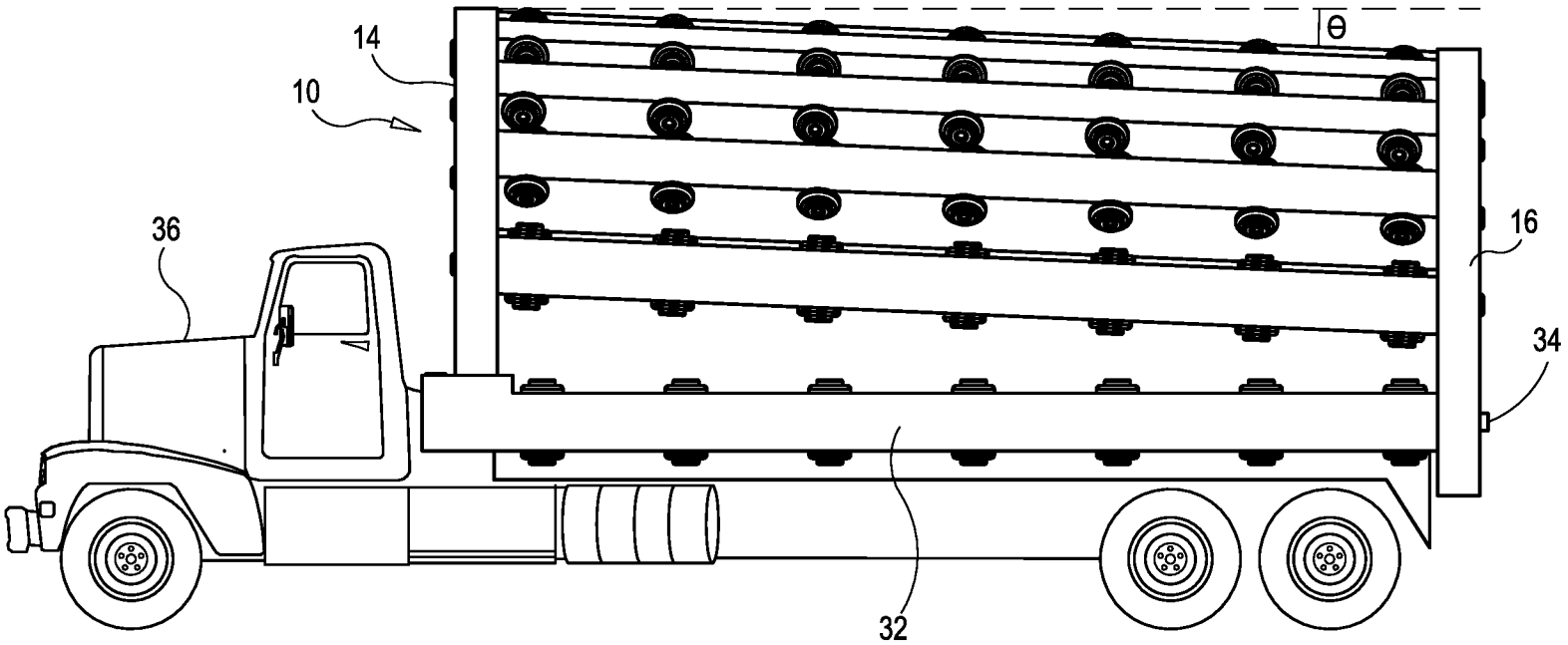
FIG. 2 is an elevation view showing the formwork of FIG. 1 mounted on a vehicle.

The end panels 14 and 16 are generally semicircular with the longitudinal members 12*a*, 12*b* and 12*c* being secured to the end panels 14 and 16 near respective arched peripheral edges 28 and 30 thereof. The longitudinal members 12*a*, 12*b* and 12*c* are thereby arranged in a generally arcuate formation providing the formwork 10 with an arcuate profile. Referring now to FIG. 2, the end panels 14 and 16 are vertically offset such that a front one of the end panels 14 has a higher profile than a rear one of the end panels 16. This provides the formwork 10 with a slope θ running downwardly from the front end panel 14 to the rear end panel 16. The slope θ may be adjusted by repositioning where a longitudinal base member 32 is secured to the rear end panel 16. This may readily be done by removing bolt 34 to allow the longitudinal base member 32 to be repositioned and then reinserting bolt 34 to secure the repositioned longitudinal base member 32 to the rear end panel 16. It will be understood by a person skilled in the art that a second longitudinal base member (not shown in FIG. 2), which is coplanar with the longitudinal base member 32 shown in FIG. 2, must also be similarly repositioned.

Figure 3:
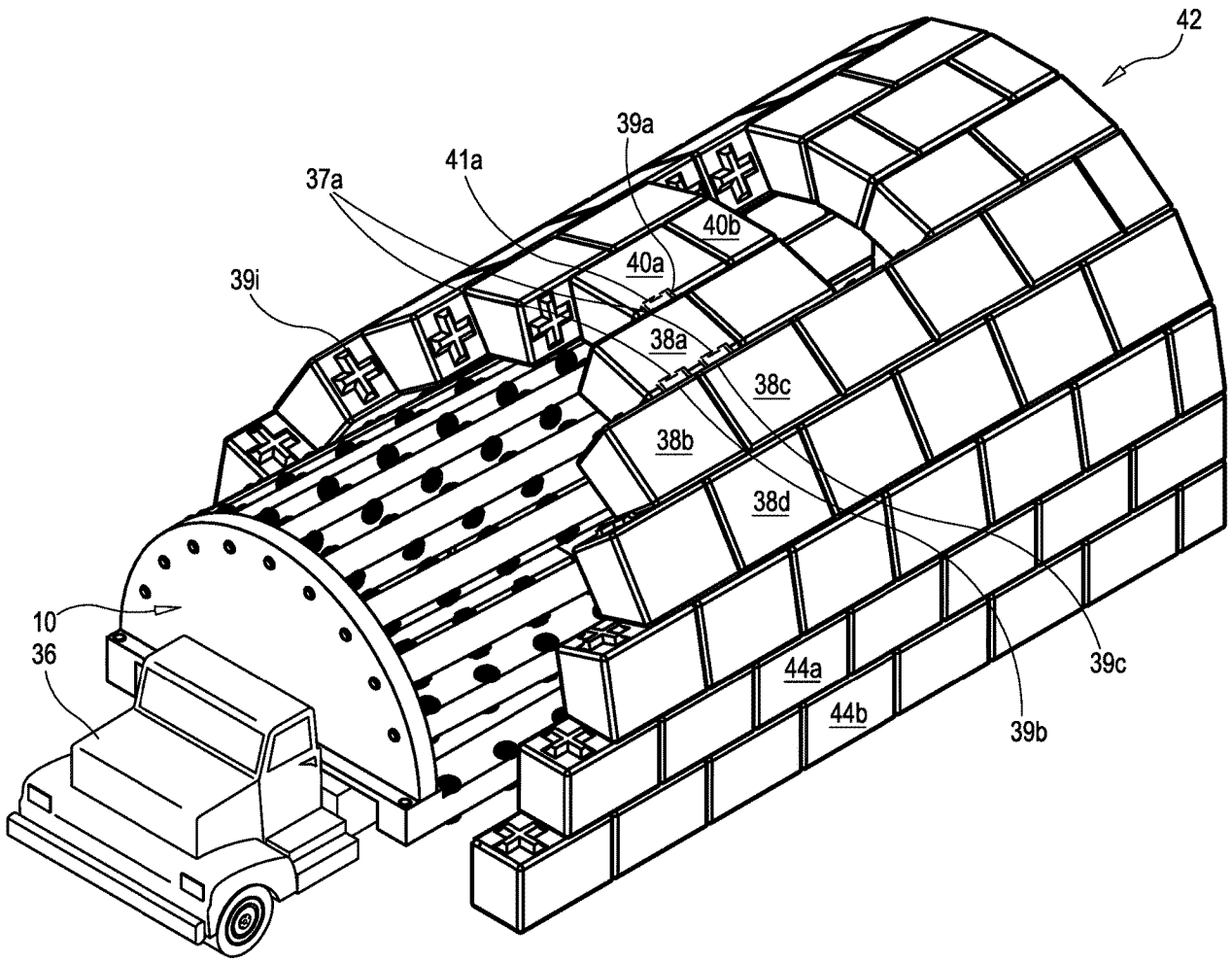
FIG. 3 is a perspective view showing the formwork of FIG. 1 mounted on the vehicle and a partially constructed arched structure.
Figure 4:
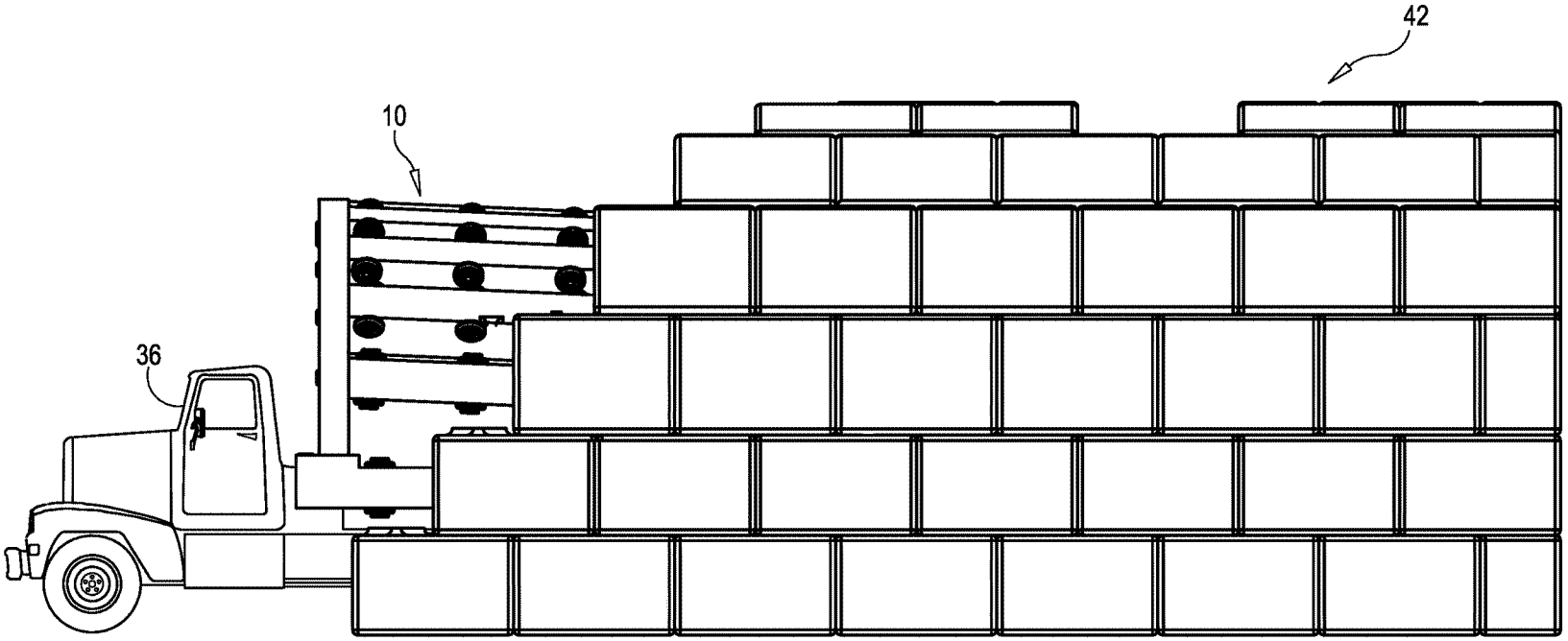
FIG. 4 is a side elevation view of the embodiment of FIG. 3.
Figure 5:
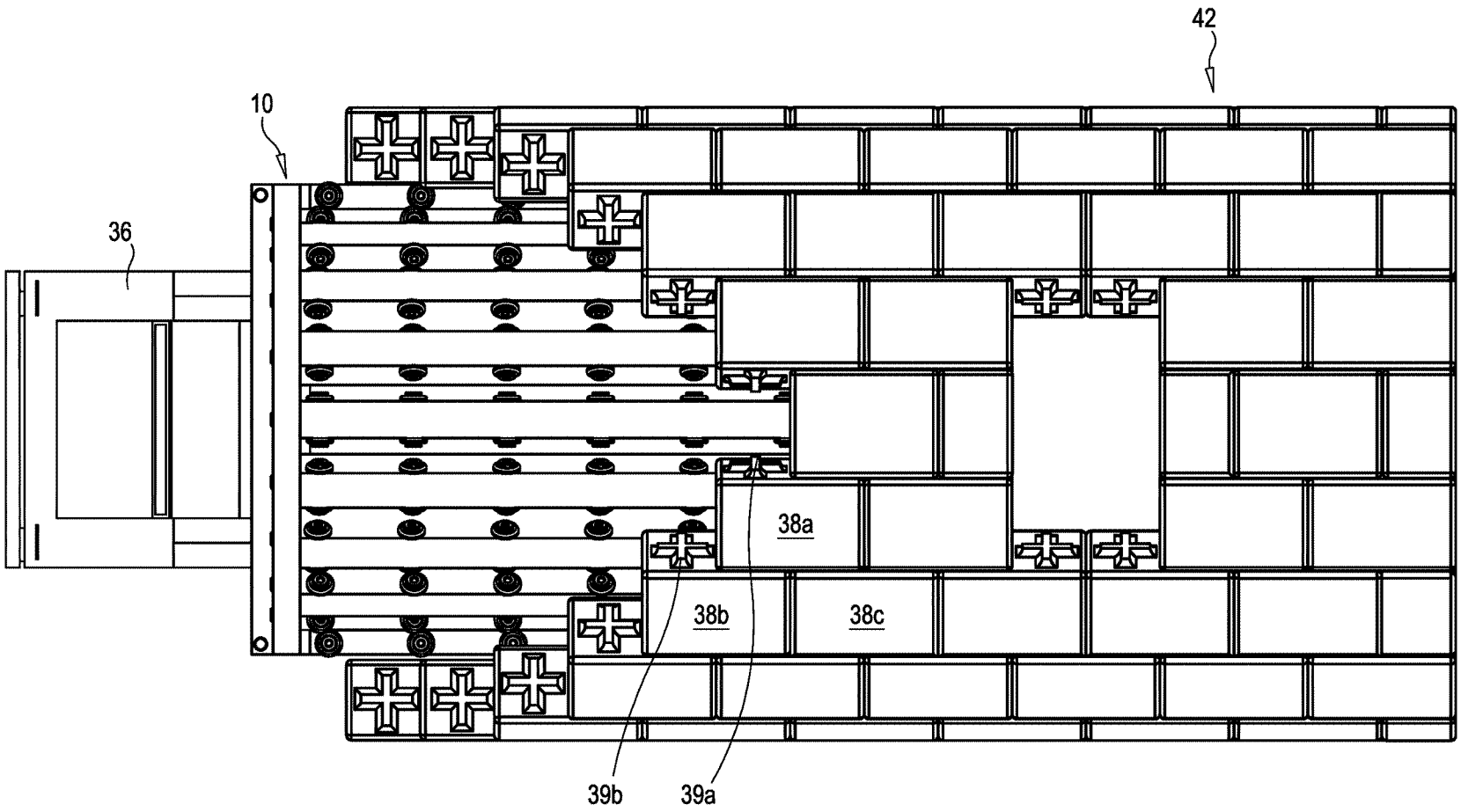
FIG. 5 is a top plan view of the embodiment of FIG. 3.

In use the formwork 10 is typically mounted on a vehicle 36 and, as shown in FIGS. 3 to 5, the arcuate profile of formwork 10 supports a plurality of voussoirs, for example voussoirs 38*a*, 38*b*, 38*c* and 38*d*, and keystones, for example keystones 40*a* and 40*b*, during the construction of an arched structure 42. Any suitable type of interlocking voussoirs and keystones may be used although, in this example, the voussoirs and keystones are similar to the type disclosed in U.S. Pat. No. 6,391,797 which issued to Drew on Aug. 23, 2005 and the full disclosure of which is incorporated herein by reference. The voussoirs and keystones are substantially similar in structure and function. Accordingly, only one of the voussoirs 38*a* and one of the keystones 40*a* is described in detail herein with the understanding that the remaining voussoirs and keystones have a substantially similar structure and function in a substantially similar manner.

The voussoir 38*a* includes recesses 37*a* and protrusions 39*a*. In this example the recesses and protrusions are cross shaped. The recesses 37*a* of the voussoir 38*a* receive corresponding protrusions 39*b* and 39*c* of adjacent voussoirs 38*b* and 38*c*. One of the protrusions 39*a* of the voussoirs 38*a* is shown in greater detail in FIG. 5. The protrusions 39*a* of the voussoir 38*a* engage a corresponding recess 41*a* of the keystone 40*a*, as best shown in FIG. 3. This allows the voussoirs and keystones to interlock, thereby preventing slippage and stabilizing the arched structure 42. The arched structure 42 also includes a plurality of imposts 44*a* and 44*b* which are not supported by the formwork 10 but also function to support the voussoirs as is known in the art. The imposts 44*a* and 44*b* are provided with similar recesses and protrusions (not shown) to allow for interlocking with other imposts and the voussoirs.

Figure 6:
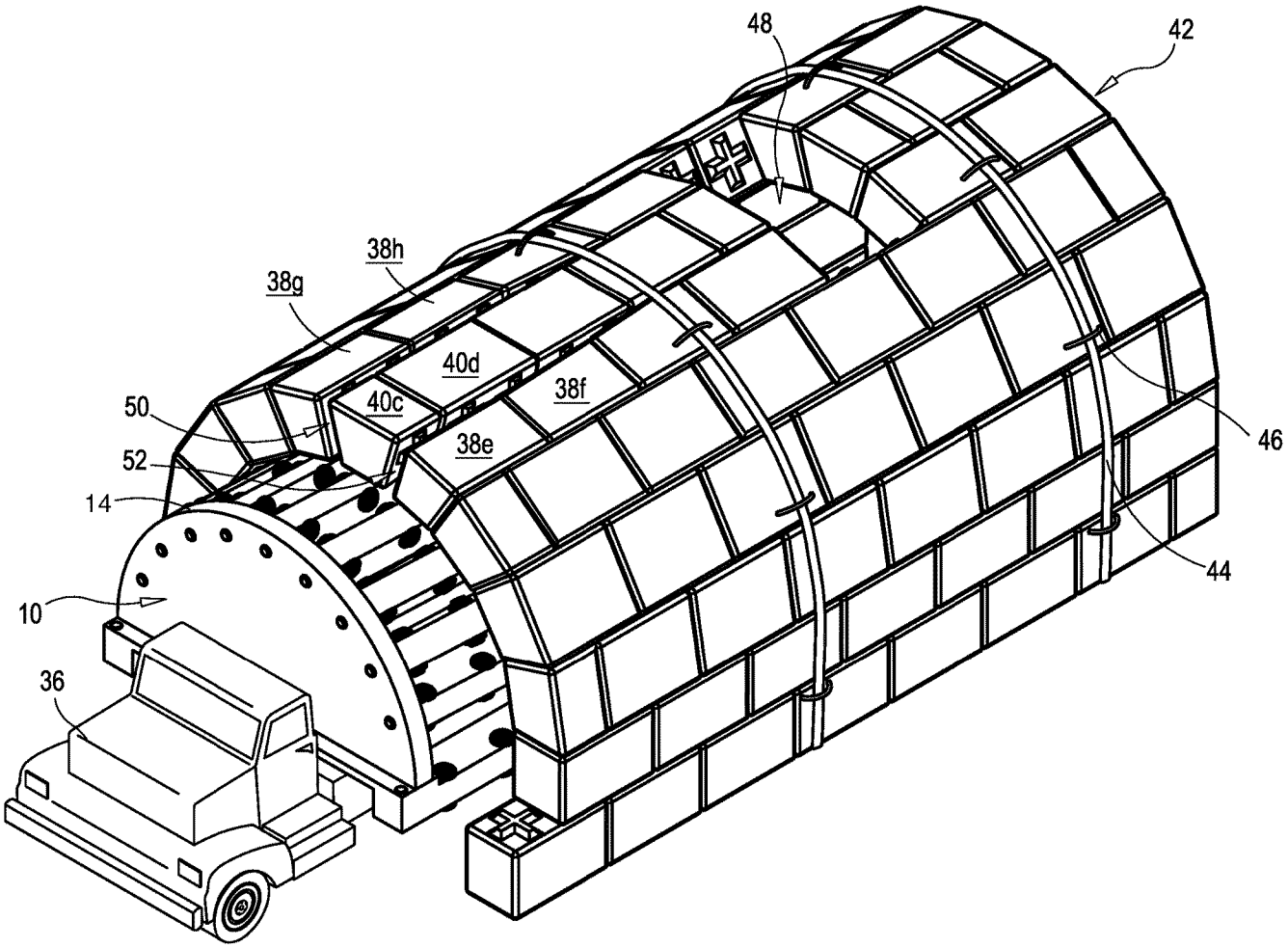
FIG. 6 is another perspective view showing the formwork of FIG. 1 and a partially constructed arched structure.
Figure 7:
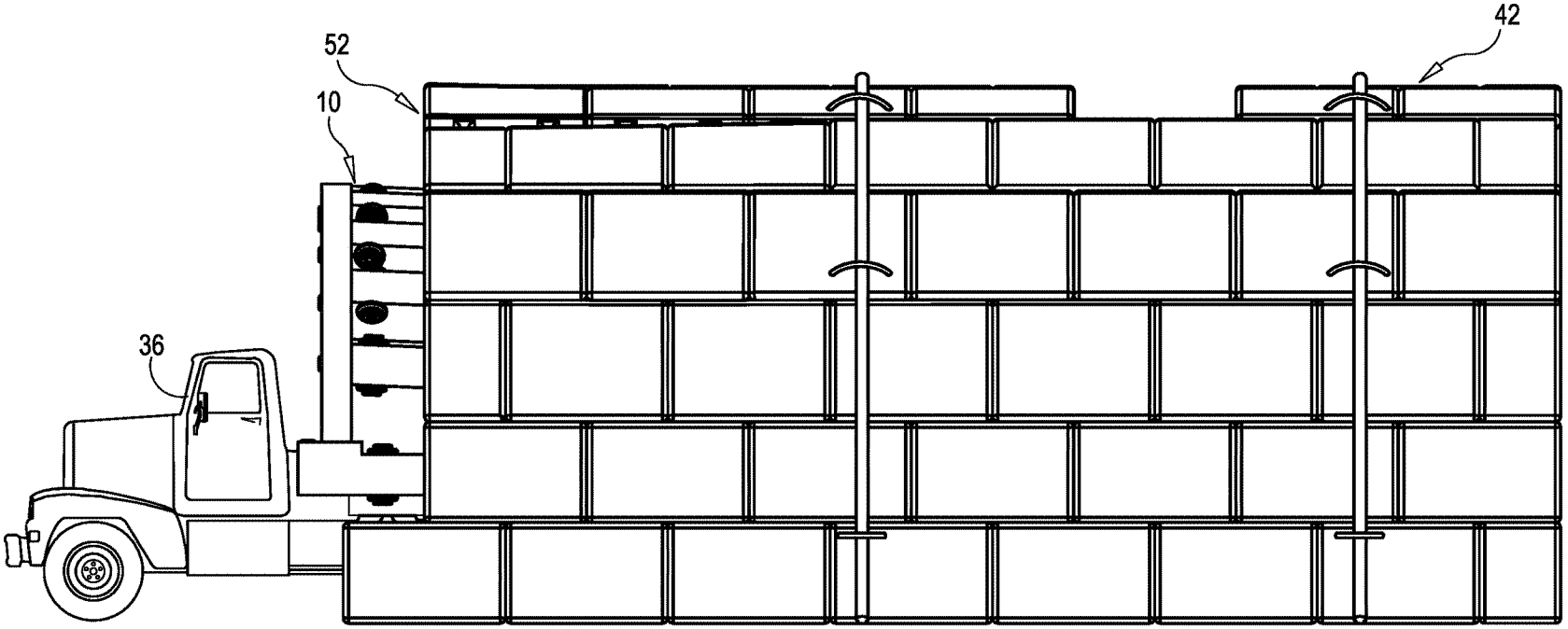
FIG. 7 is a side elevation view of the embodiment of FIG. 6.
Figure 8:
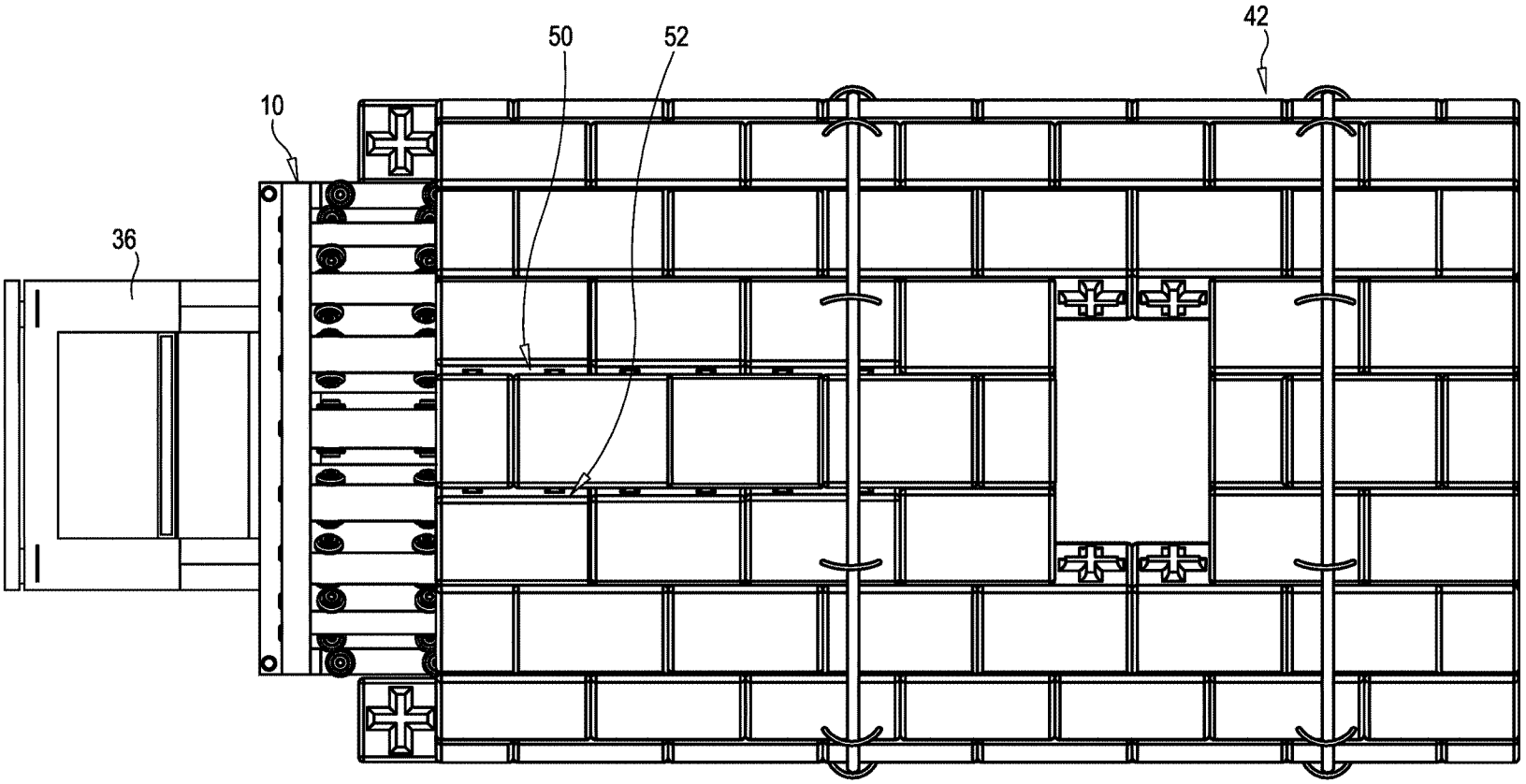
FIG. 8 is a top plan view of the embodiment of FIG. 6.

The arched structure 42 is further constructed, as shown in FIGS. 6 to 8, by setting additional voussoirs, for example voussoirs 38*e*, 38*f*, 38*g* and 38*h*, and keystones, for example keystones 40*c* and 40*d*, towards the front end panel 14 of the formwork 10. Completed portions of the arched structure 42 may be reinforced with tension straps 44 extending along an extrados of the arched structure 42 to prevent outward movement of the voussoirs. The tension straps 44 may extend through connectors 46 in the voussoirs which, in this example, are lugs formed of metal embedded in the concrete at the time the voussoirs are cast. The arched structure 42 may also be provided with a radial opening 48 at a top thereof.

Figure 9:
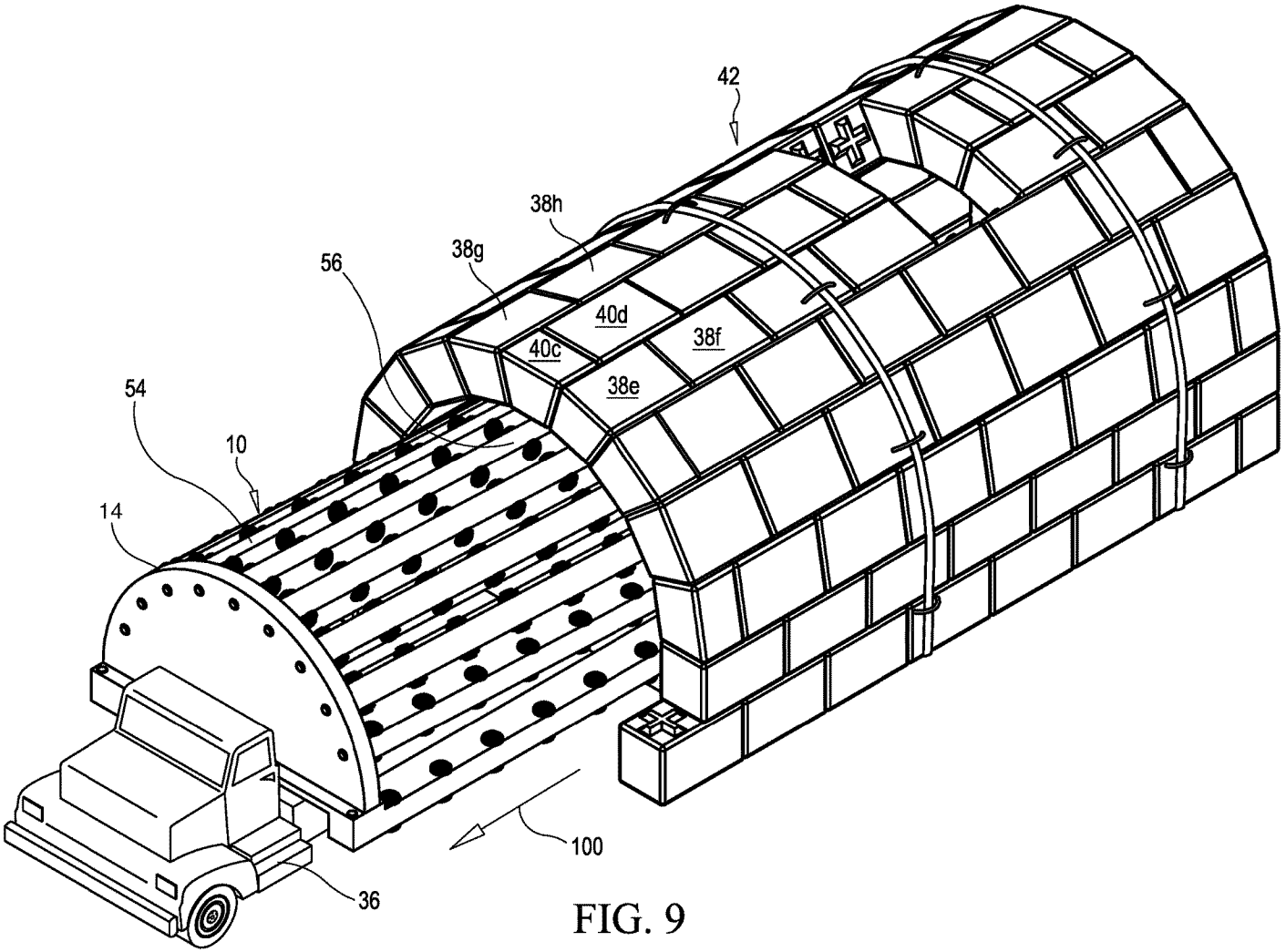
FIG. 9 is a yet another perspective view showing the formwork of FIG. 1 and a partially constructed arched structure.

As best shown in FIG. 6, when the keystones 40*c* and 40*d* are set towards the front end panel 14 of the formwork 10, there are gaps 50 and 52 between the keystones 40*c* and 40*d* and their engaging voussoirs 38*e*, 38*f*, 38*g* and 38*h*. The gaps 50 and 52 allow the keystones 40*c* and 40*d* to be set between opposing voussoirs despite the protrusions (not shown in detail in FIG. 6) on the voussoirs. As shown in FIG. 9, as the formwork 10 is moved forward by the vehicle 36 in the direction generally indicated by arrow 100, the keystones 40*c* and 40*d* interlock with the voussoirs 38*e*, 38*f*, 38*g* and 38*h*. This is a function of the slope θ, shown in FIG. 2, of the formwork 10.

A front portion 54 of the formwork 10 pushes the voussoirs 38*e*, 38*f*, 38*g* and 38*h* outward to allow the keystones 40*c* and 40*d* to be set. However, since the formwork 10 slopes downwardly towards a rear portion 56 thereof, as the vehicle 36 moves in the direction of arrow 100 the voussoirs move inward due to gravity and the keystones 40*c* and 40*d* move downward due to gravity. This allows the voussoirs and keystones to interlock. Accordingly, as the formwork 10 is moved forward in the direction of arrow 100, the relative positions of the voussoirs 38*e*, 38*f*, 38*g* and 38*h* is shifted from the front portion 54 of the formwork 10, as shown in FIG. 6, to the rear portion 56 of the formwork 10, as shown in FIG. 9, thereby allowing the voussoirs and keystones to interlock and the arched structure to be completed. Mounting the formwork 10 on a vehicle 36 allows the formwork to be readily moved forward. Mounting the formwork 10 on the vehicle 36 also allows a length of the arched structure 42 to be easily extended by simply moving the vehicle forward and setting additional voussoirs on the then exposed formwork 10.

Figure 10:
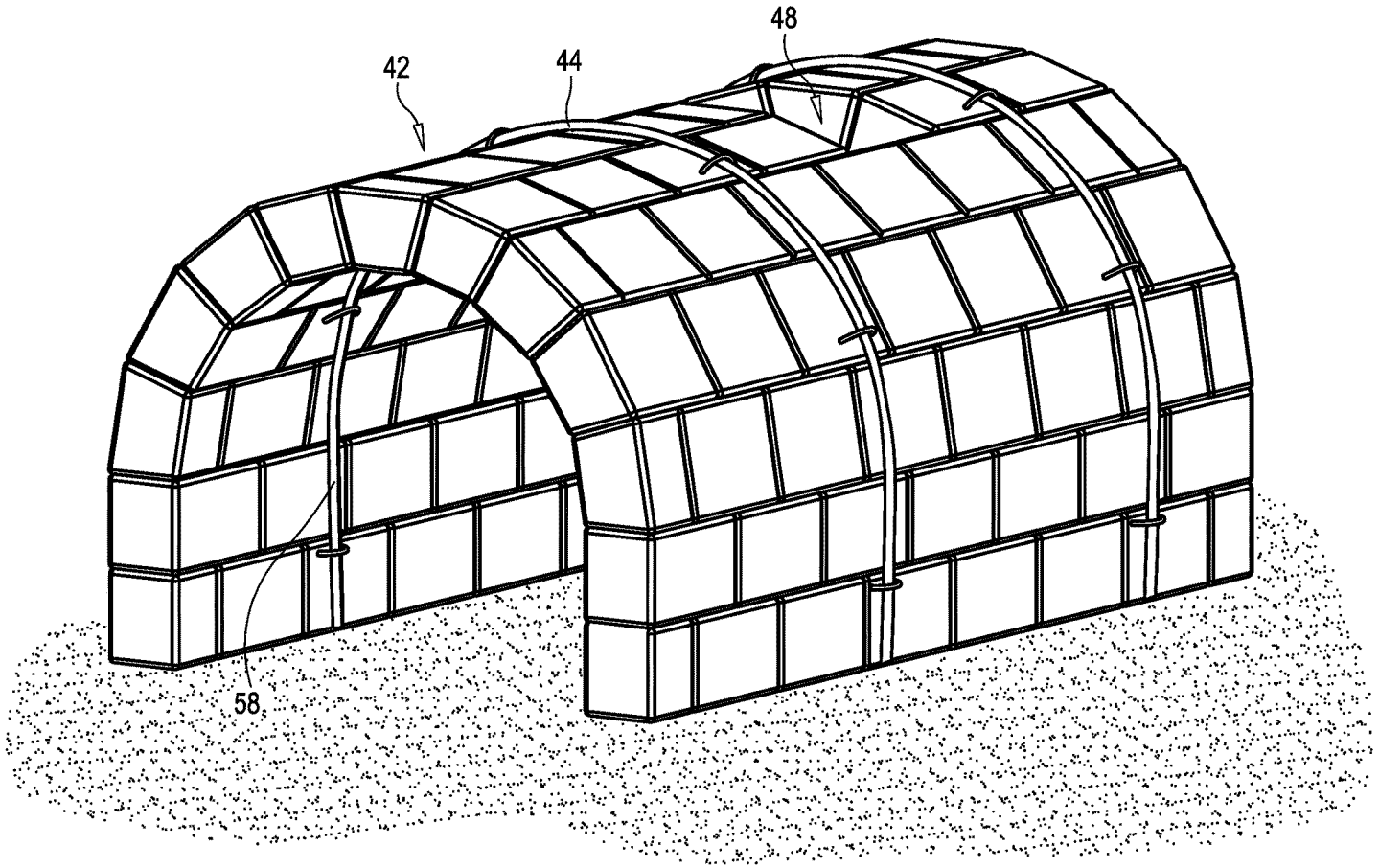
FIG. 10 is a perspective view showing an arched structure constructed using the formwork of FIG. 1.
Figure 11:
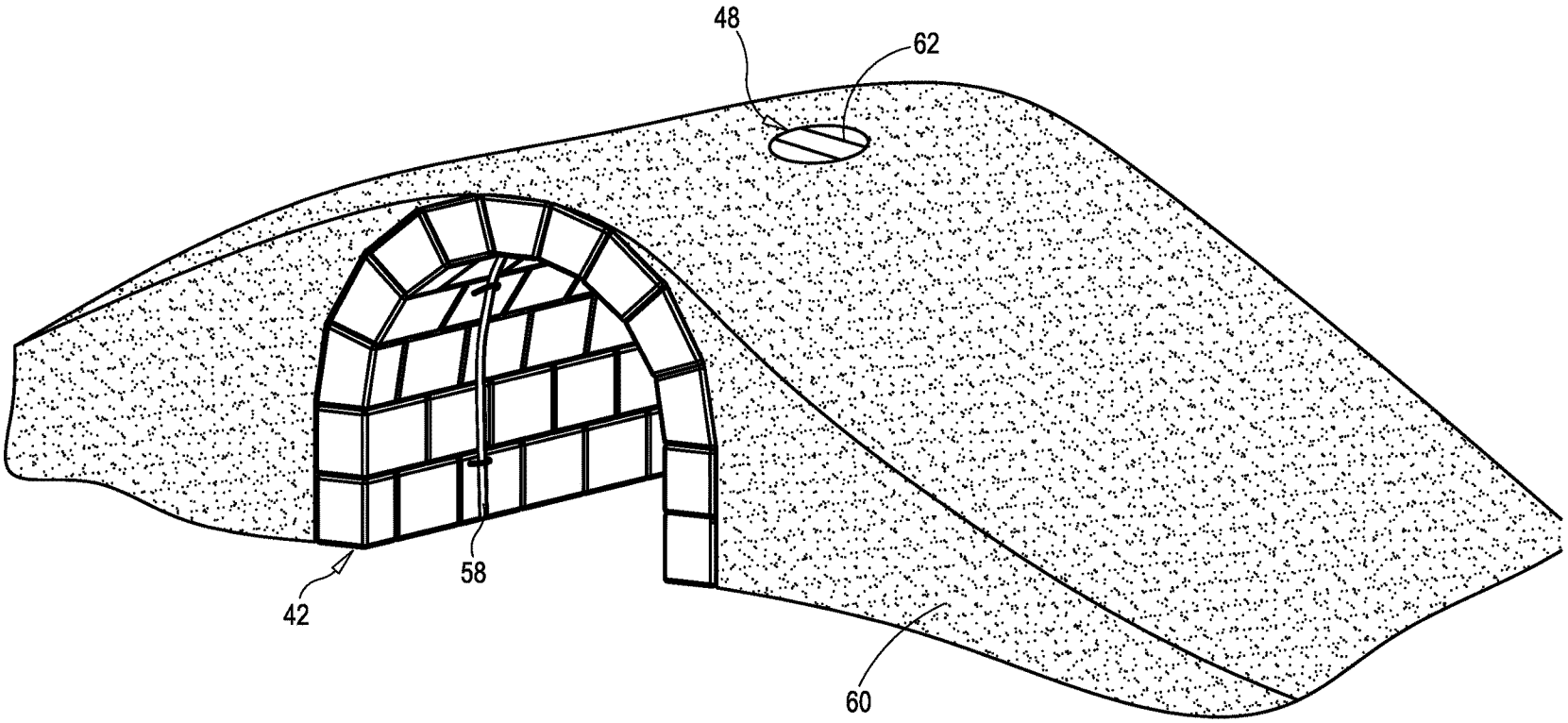
FIG. 11 is a perspective view showing an arched structure constructed using the formwork of FIG. 1 with the addition of ground filler over the structure.

FIG. 10 shows the completed arched structure 42 which may further be reinforced with tension straps 58 extending along an intrados of the arched structure 42 to prevent inward movement of the voussoirs. FIG. 11 shows the completed arched structure 42 buried under ground filler 60. The radial opening 48 allows access to the arched structure 42 upon removal of a cover 62 which is provided for safety reasons.

Figure 12:
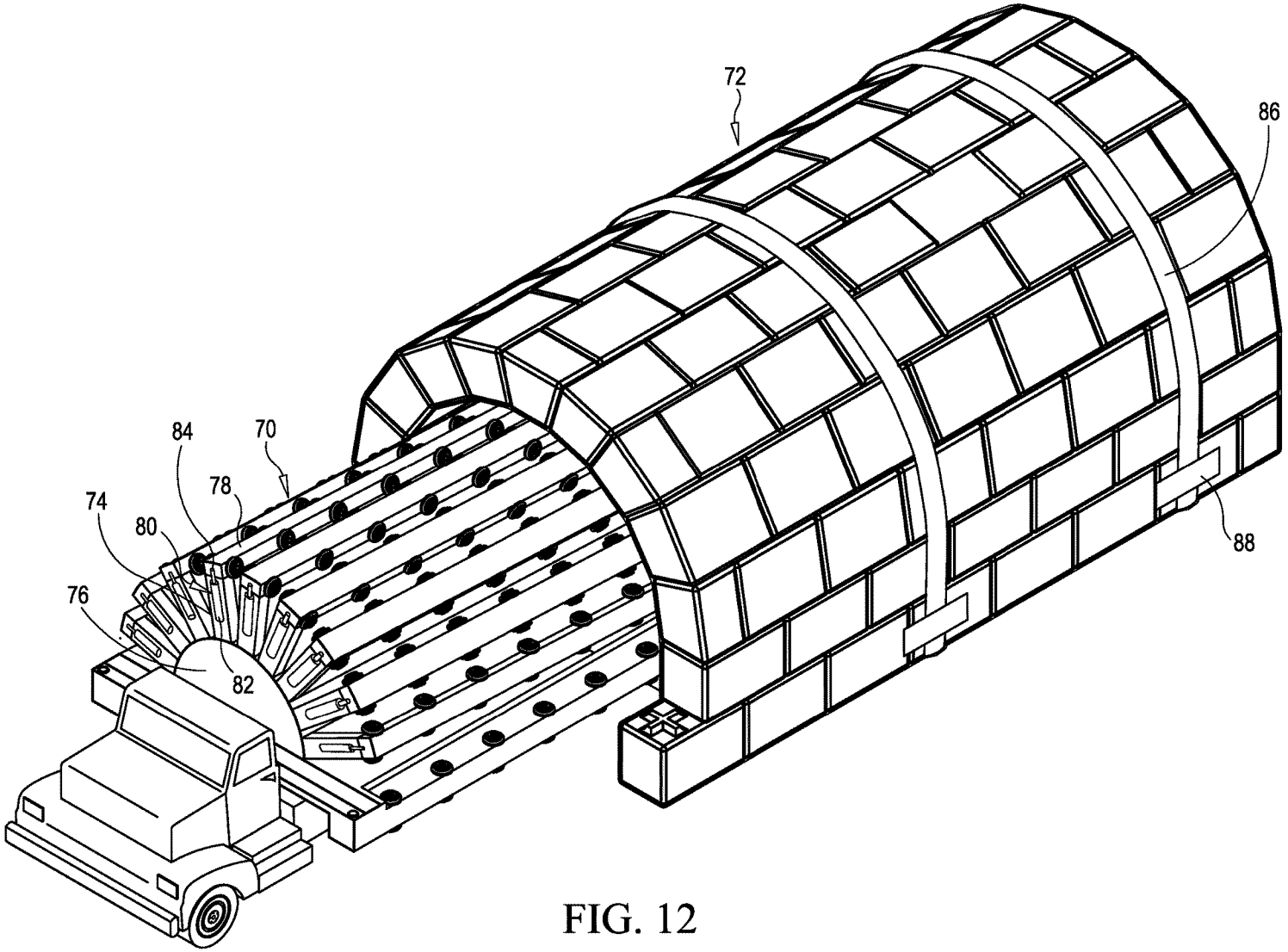
FIG. 12 is a perspective view showing a second embodiment of an improved formwork for use in the construction of an arched structure and a partially constructed arched structure.

Referring now to FIG. 12, a second embodiment of an improved formwork 70 for use in the construction of an arched structure 72 is shown. The second embodiment of the formwork 70 is generally similar to the first embodiment of the formwork 10. The second embodiment of the formwork 70 however has a plurality of radial struts, for example radial strut 74, extending from an end panel 76. The radial struts are substantially similar in structure and function. Accordingly, only one radial strut 74 is described in detail herein with the understanding that the remaining radial struts have a substantially similar structure and function in a substantially similar manner. The radial strut 74 is coupled to a corresponding longitudinal member 78 which is similar to the longitudinal member 12*a* shown in FIG. 1. In particular, and as shown in FIG. 12, an actuator 80 couples the radial strut 74 to the longitudinal member 78. This allows motion to be imparted to individual ones of the longitudinal members, and thereby to the arched structure 72 to cause offset voussoirs to be set. In this example, the actuator is a hydraulic actuator 80 with a hydraulic cylinder 82 secured to the radial strut 74 and a piston rod 84 coupled to the longitudinal member 78. In other examples, other types of actuators or vibrators may be used.

Figure 13:
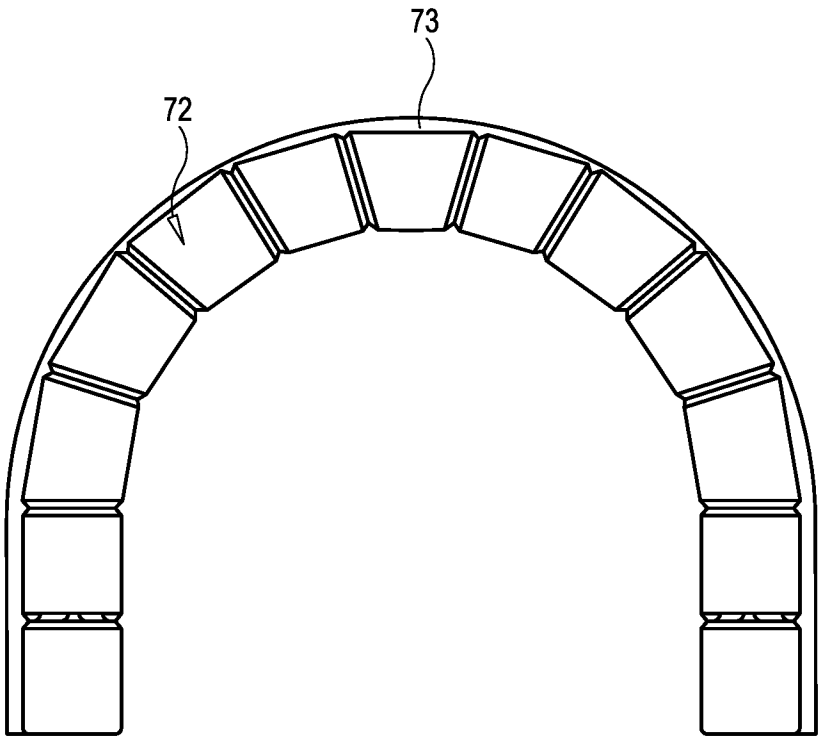
FIG. 13 is a front elevation view of the partially constructed arched structure of FIG. 12 showing a lining coating the arched structure.

Completed portions of the arched structure 72 may be reinforced with flattened tension strips 86 extending along an extrados of the arched structure 72 to prevent outward movement of the voussoirs. The flattened tension strips 86 may extend through connectors 88 in the voussoirs which, in this example, are flattened lugs formed of metal embedded in the concrete at the time the voussoirs are cast. The use of flattened tension strips and flattened lugs allow the extrados of the arched structure 72 to be coated with a lining 73 as shown in FIG. 13. The lining 73 may be an epoxy lining that may be sprayed-on, coated-on, or rolled-on using self-adhesive pads. The lining 73 may provide seismic resistance, exterior support, and waterproofing.

Figure 14:
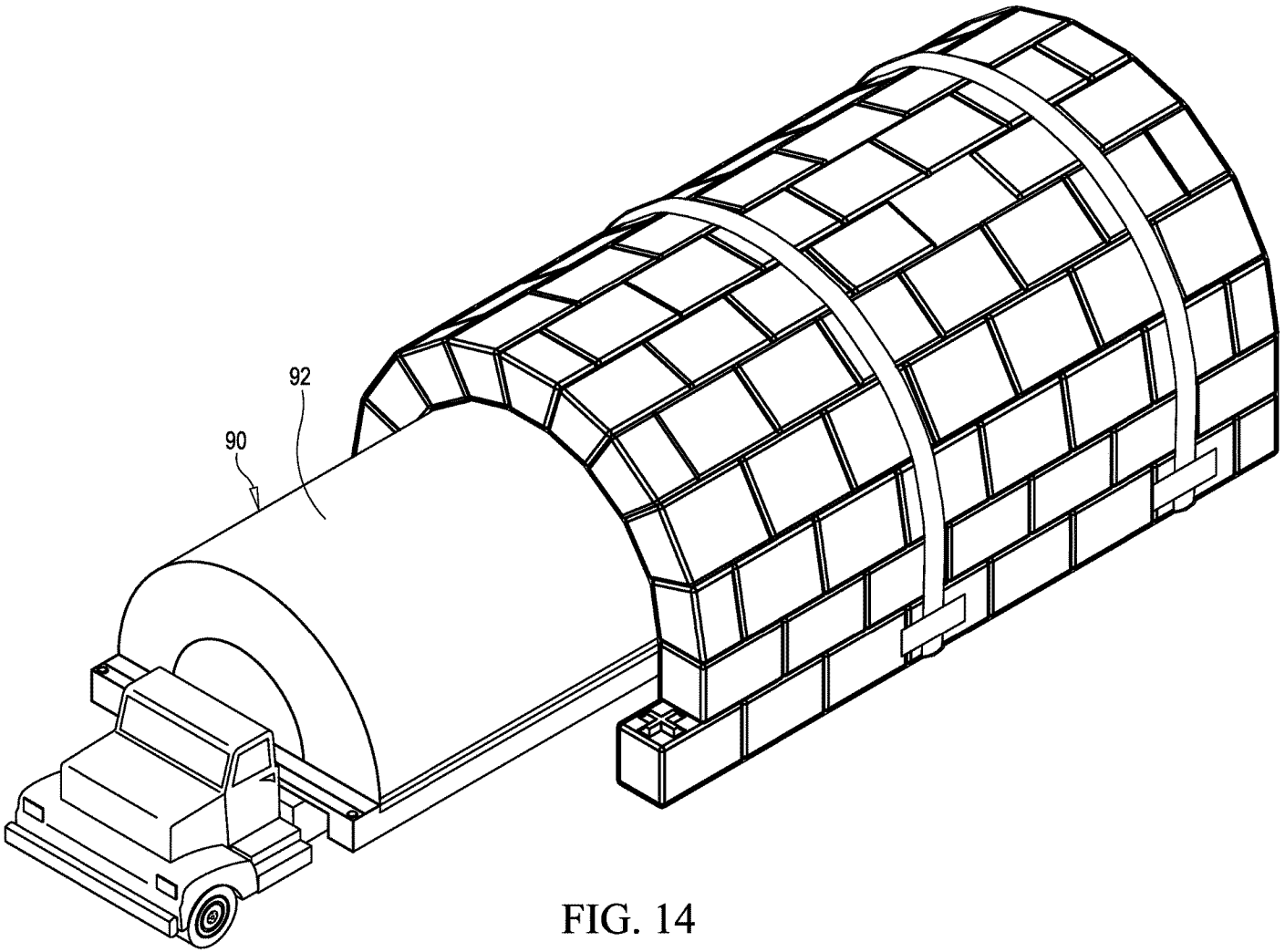
FIG. 14 is a perspective view showing a third embodiment of an improved formwork for use in the construction of an arched structure and a partially constructed arched structure.

Referring now to FIG. 14, a third embodiment of an improved formwork 90 for use in the construction of an arched structure is shown. The third embodiment of the formwork 90 is generally similar to the first embodiment of the formwork 10. The third embodiment of the formwork 90 however does not have a plurality of longitudinal members extending between the end panels. Instead the third embodiment of the formwork 90 has a single longitudinal member in the form of a sloped arched surface 92 formed from a slippery composite material extending between the end panels.

It will be understood by a person skilled in the art that terms "front", rear", "higher", "lower", "forward" and "downward" are used herein only in relation to the position and orientation of the formwork as shown in the drawings.

It will also be understood by a person skilled in the art that many of the details provided above are by way of example only, and are not intended to limit the scope of the invention which is to be determined with reference to the following claims.

What is claimed is:

1. A method of constructing an arched structure comprising:

providing a formwork having a first end, a second end, and a plurality of longitudinal members, each of the longitudinal members extending between the first end of the formwork and the second end of the formwork, wherein the longitudinal member slopes downwardly from the first end of the formwork to the second end of the formwork and there are rollers mounted on and along each of the longitudinal members;

using the formwork to support placing a plurality of interlocking voussoirs and keystones during the constructing of a portion of the arched structure; and pulling the formwork out of the portion of the arched structure after the interlocking voussoirs and keystones are placed, wherein the formwork is pulled out of the portion of the arched structure by the first end of the formwork to cause the voussoirs to move inward and the keystones to move downward and thereby causing the voussoirs and the keystones to interlock.

2. The method as claimed in claim 1 further including providing the formwork with an actuator or vibrator.

3. The method as claimed in claim 2 further including imparting movement to the longitudinal member to cause offset voussoirs to be set.

4. The method as claimed in claim 1 further including extending tension straps along an extrados of the arched structure to prevent outward movement of the voussoirs.

5. The method as claimed in claim 1 further including extending tension straps along an intrados of the arched structure to prevent inward movement of the voussoirs.

6. The method as claimed in claim 1 further including providing the arched structure with a lining.

7. The method as claimed in claim 1 further including providing an extrados of the arched structure with an epoxy lining.

* * * * *